US005105839A

United States Patent [19]

Case et al.

[11] Patent Number: 5,105,839

[45] Date of Patent: Apr. 21, 1992

[54] SMOKING ARTICLES

[75] Inventors: Paul D. Case, Bassett; Alan G. Stephenson, Ringwood, both of England

[73] Assignee: British-American Tobacco Company Limted, London, England

[21] Appl. No.: 566,251

[22] Filed: Aug. 13, 1990

[30] Foreign Application Priority Data

Aug. 15, 1989 [GB] United Kingdom ..... 8918556

[51] Int. Cl. ..... A24B 1/00; A24B 1/02; A24B 1/04; A24B 3/04

[52] U.S. Cl. ..... 131/365; 131/331; 131/364

[58] Field of Search ..... 131/365, 331, 364

[56] References Cited

U.S. PATENT DOCUMENTS

Re. 32,615 3/1988 Luke ..... 131/360
4,624,268 11/1986 Baker et al. ..... 131/365
4,964,427 10/1990 Case et al. ..... 131/364

FOREIGN PATENT DOCUMENTS 2118423 11/1983 United Kingdom .

*Primary Examiner*—V. Millin
*Attorney, Agent, or Firm*—Kane, Dalsimer, Sullivan, Kurucz, Levy, Eisele and Richard

[57] ABSTRACT

Smoking articles in the form of a smoking material rod enclosed with a filter means by a paper wrapper are described wherein the density of the smoking material is in a range of from about 100 mg $cm^{-3}$ to about 260 mg $cm^{-3}$. The smoking material contains at least 20% by weight of expanded tobacco while the filter means has a filtration efficiency less than about 45% for removal of particulate matter. Ventilation means is operable to provide a ventilation level of at least 30%. Smoking articles in accordance with the disclosure exhibit acceptable mainstream smoke over the whole of the smoking process, i.e., there is less perception of an increase in mainstream smoke temperature.

10 Claims, 1 Drawing Sheet

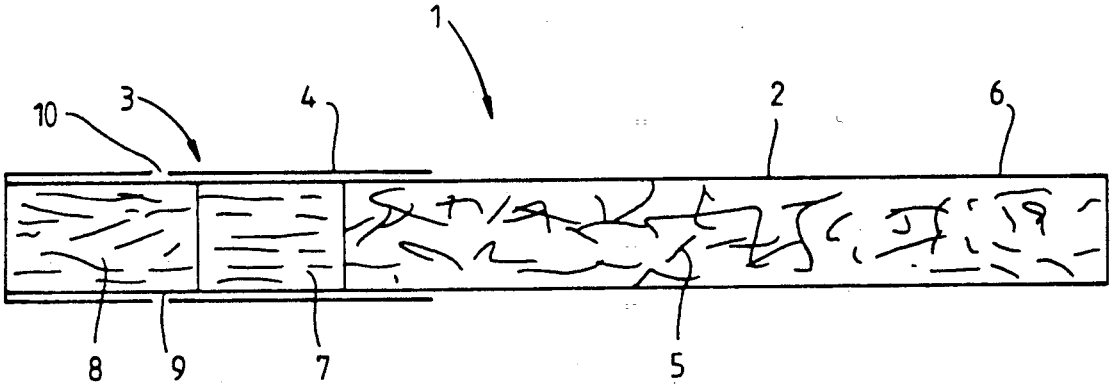
1
10
3
4
2
6
8
9
7
5

SMOKING ARTICLES

BACKGROUND OF THE INVENTION

1. Field of the Invention

The invention the subject of this application relates to cigarettes ad similar smoking articles, smoking material of which comprises expanded tobacco.

2. Brief Description of the Prior Art

It has been observed that when the cut tobacco filler of a cigarette includes a proportion of expanded tobacco, DIET-expanded tobacco for example, a smoker of the cigarette is likely to perceive that the mainstream smoke is hotter over the last few puffs than during the prior puffs.

An object of the subject invention is the provision of a smoking article, the smoking material of which comprises expanded tobacco, but which smoking article nevertheless provides to the smoker acceptable mainstream smoke over the whole of the smoking process.

It has also been observed that when smoking articles having a low density smoking material rod are wrapped with wrappers which, when wrapped around conventional density smoking material rods, effect a reduction in sidestream smoke constituents, the ratio of carbon monoxide (CO) to particulate matter, water and nicotine free (PMWNF), of the mainstream smoke is greater than one, i.e. there is little parity in CO and PMWNF. Efforts to reduce the CO to PMWNF ratio using a lower pressure drop cellulose acetate filter results in a more acceptable CO to PMWNF ratio but with poor smoking article mechanics, which mechanics are unacceptable to the smoker.

It is a further object of the subject invention to provide a smoking article which has acceptable smoke mechanics and a substantially matched CO to PMWNF ratio.

SUMMARY OF THE INVENTION

The present invention provides a smoking article comprising a material rod and filter means disposed at one end of said rod, said rod comprising smoking material and a paper wrapper circumscribing said smoking material, the density of said smoking material in said rod being in a range of about 100 mg $cm^{-3}$ to about 260 mg $cm^{-3}$, and said filter means comprising a body of low filtration efficiency material and ventilation means.

Preferably, the smoking material comprises at least 20% by weight of expanded tobacco, and may comprise at least 30% and, more preferably, at least 40% of expanded tobacco.

BRIEF DESCRIPTION OF THE DRAWING

The accompanying drawing is a cross-sectional side elevation of an embodiment cigarette of the invention.

DETAILED DESCRIPTION OF THE PREFERRED EMBODIMENTS OF THE INVENTION

In smoking articles according to the present invention smoking material not being expanded tobacco preferably comprises leaf tobacco, suitably in conventional cut filler form. The leaf tobacco may be lamina and/or stem tobacco. Smoking material not being expanded tobacco may comprise a reconstituted tobacco or a tobacco substituted.

The expanded tobacco may be lamina and/or stem tobacco. The expanded tobacco is advantageously a lamina tobacco the product of a tobacco expansion process which is effective to provide a high degree of expansion in tobacco subjected to the process. High expansion processes are disclosed, for example, in the specification of U.S. Pat. No. Re. 30,693 and in United Kingdom Patent Specifications Nos. 1,570,270 and 2,160,408A. By the use of high expansion processes, tobacco expansion values, in terms of filling value increase, of from about, typically, 75% and even up to about 125% may be obtained. Tobacco which has been subjected to a high expansion process may have a bulk density of, for example, from about 100 mg $cm^{-3}$ to about 175 mg $cm^{-3}$, as measured using a Borgwaldt Densimeter.

Preferably, the body of low filtration efficiency material comprises cellulose acetate and/or polyolefin, polypropylene or polyethylene, for example.

Preferably, the ventilation means is located at or downstream of the body of low filtration efficiency material. Suitably, the level of ventilation is high, say at least 30% or more, more suitably, at least 40% or more and even more suitably, at least 50% or more.

Suitably, the paper wrappers of smoking material rods of smoking articles in accordance with the subject invention comprise a sidestream reducing agent. There may be utilised, for example, a wrapper paper comprising a total filler content of about 20 per cent by weight, or less, a proportion at least of the filler being a filler, magnesium oxide and/or hydroxide for instance, which is effective for visible sidestream reduction, the weight of the paper being about 30 grams per square meter or more.

Advantageously, the inherent permeability, i.e. that due to viscous flow, of paper wrappers of smoking material rods of smoking articles i accordance with the subject invention is not more than about 20 Coresta units and is more advantageously not more than about 10 Coresta units.

In addition, the paper wrappers of smoking material rods of smoking articles in accordance with the subject invention may comprise a burn retardant. As used herein the term "burn retardant" means a substance the inclusion of which in or on a paper wrapper of a smoking material rod effects a reduction in the smoulder rate of the smoking material rod. The term "burn retardant" can refer to the use of two or more such substances, as well as to the use of a single such substance. Suitable burn retardants will be known to those skilled in the art. Reference is directed to those substances mentioned in our co-pending U.K. Patent Application No. 8820498.7. Suitable water soluble and water insoluble substances and their respective loading levels are described therein.

The filter means may further comprise one or more bodies of filtration material, in conjunction with/or a ventilated tubular mouthpiece element.

In order that the subject invention may be clearly understood and readily carried into effect, reference will now be made, by way of example, to the diagrammatic drawing hereof, which shows, in axial section, a cigarette.

The cigarette shown in the drawing, which cigarette is generally designated by reference numeral 1, comprises a cigarette rod 2 and a dual filter 3, which filter 3 is interattached with the rod 2 by means of a tipping wrapper 4.

The cigarette rod 2 comprises a cut tobacco filler 5, 40% of the weight of which filler 5 is accounted for by DIET-expanded tobacco. The density of filter 5 in cigarette rod 2 is 200 mg $cm^{-3}$.

The cigarette rod 2 further comprises a cigarette paper wrapper 6 comprising as filler 4.9% by weight chalk and 10.5% by weight magnesium oxide. The wrapper 6 has a basis weight of 36.6 g $m^{-2}$ and an air permeability of 7.0 Coresta units. The wrapper 6 includes no burn additive.

The filter 3 comprises a plug 7 of polyethylene, in abutment with the cigarette rod 2, and a plug 8 of cellulose acetate in abutment with the plug 7. The plugs 7 and 8 are interattached by a circumscribing porous plugwrap 9. The filter 3 was supplied by Filtrona Limited under the designation "Ratio Filter" and is described in U.K. Patent Specification No. 2 118 423A. It is disclosed therein that the filtration efficiency of the plug 7 is at most 45 percent and may be in the range of 12 to 40 percent.

The tipping wrapper 4 comprises a ring of ventilation perforations 10 so located that during the smoking of the cigarette 1 ventilation air enters the plug 8 through the peripheral surface thereof.

Cigarette 1 provides an acceptably cool mainstream smoke throughout the smoking process and suffers less from hot collapse.

In order to assess the CO to PMWNF ratio for cigarettes according to the subject invention the following test cigarettes were prepared.

EXAMPLE 1

Cigarettes A according to the invention of a circumference of 24.75 mm and having a 59 mm long smoking material rod and 25 mm long filter body were produced. The tobacco rod density was 190 mg $cm^{-3}$, the expanded tobacco being 40% of DIET tobacco. The rod was wrapped in a paper having a basis weight of 37.5 g $m^{-2}$ and comprising 11.5% magnesium oxide, 4.3% calcium carbonate and 4.6% sodium acetate. The paper had an inherent permeability of 5.0 Coresta units, but was electrostatically perforated to a total permeability of 55 Coresta units. The filter body comprised an 8 mm long polyethylene filter element having a pressure drop of 175 mm WG and 17 mm long cellulose acetate filter element having a pressure drop of 40 mm WG. The Cigarettes A were ventilated to a level of 71-72%. The unbound pressure drop was 96 mm WG.

Control Cigarettes, Cigarettes B, of the same format were wrapped in a wrapper having a permeability of 50 Coresta units and a basis weight of 29 g $m^{-2}$. The paper comprised 21% chalk and 2% mixed sodium citrate and potassium citrate. The filter body comprised a 25 mm long cellulose acetate element. The density of the tobacco rod was 246 g $cm^{-3}$. The cigarettes were ventilated to a level of 57% and had an unbound pressure drop of 100 min WG.

Cigarettes A and B were smoked under standard machine smoking conditions, i.e. a 35 $cm^3$ puff of 2 seconds duration every minute, to a cigarette tobacco rod butt length of 8 mm and measurements of the mainstream and sidestream smoke component yields were taken. These are outlined in Table 1 below.

TABLE 1

| CIGARETTES | PMWNF (mg/cig) | TNA (mg/cig) | CO (mg/cig) | PN | CO/ PMWNF |
|---|---|---|---|---|---|
| A (MAINSTREAM) | 4.0 | 0.3 | 3.7 | 9.3 | 0.93 |
| A (SIDESTREAM) | 13.1 | 2.2 | 40 | 8.3 | — |
| B (MAINSTREAM) | 4.3 | 0.3 | 4.7 | 8.6 | 1.09 |
| B (SIDESTREAM) | 25.8 | 3.5 | 51 | 7.8 | — |

EXAMPLE 2

Cigarettes C according to the invention were produced. The cigarettes were of a circumference of 24.75 mm and had a tobacco rod length of 64 mm and 20 mm long filter body comprising a 6 mm long polyethylene filter element and a 14 mm long cellulose acetate element. The filter pressure drop was 136 mm WG. The density of the tobacco rod was 195 mg $cm^{-3}$ and comprised 13% by weight of tobacco expanded by the G13 process. The cigarettes were wrapped in a paper designated Paper C having a basis of weight of 25.4 g $m^{-2}$, and a permeability of 3 Coresta units. The paper also comprised 0.5% mono ammonium phosphate and 20.4% calcium carbonate.

Cigarettes D and E were produced having the same format. The filter body of each of these cigarettes comprised cellulose acetate. The filter pressure drop of each of these cigarettes was 50 mm WG and 70 mm WG respectively. The tobacco rod density of each of these cigarettes was 197 mg $cm^{-3}$ and 201 mg $cm^{-3}$ respectively. The cigarettes D and E were wrapped in the same paper as Cigarettes C, i.e. Paper C.

When these cigarettes were smoked under standard machine smoking conditions to a tobacco rod butt length of 10 mm, the mainstream smoke deliveries were measured. Details thereof and of the level of ventilation of each cigarette are outlined in Table 2.

TABLE 2

| PARAMETER | CIGARETTE C | D | E |
|---|---|---|---|
| % Ventilation | 50 | 50 | 45 |
| PMWNF (mg/cig) | 18.0 | 14.4 | 14.2 |
| TNA (mg/cig) | 1.71 | 1.5 | 1.45 |
| CO (mg/cig) | 14.7 | 12.3 | 14.4 |
| Puff Number | 10.3 | 11.0 | 10.7 |
| CO to PMWNF ratio | 0.82 | 0.85 | 1.01 |

It was found to be difficult to measure a quantitative temperature difference between control cigarettes and cigarettes according to the invention. Therefore, in order to provide a qualitative assessment of the perceived decrease in the hot sensation associated with cigarettes containing expanded tobacco, a subjective smoke panel test was carried out using Cigarettes C and D described above, details of which smoke panel test are outlined below.

Ten panellists were asked to comment, using a scale of 0 to 5 for increasing temperature, on the temperature of each cigarette smoked at three pre-determined locations along the tobacco rod length in a duplicated, paired comparison test. The paired comparison test comprises ten pairs of coded cigarettes. Each pair of cigarettes is smoked together and, in this case, a rating of the perceived temperature at the same pre-determined location for each cigarette is given by the smoker. Thus, twenty cigarettes are smoked. The entire test is duplicated, so that, in total, forty cigarettes are smoked. The significance of any difference is assessed using the Wilcoxon matched pairs, signed-ranks test. The results are presented below in Table 3 along with a brief conclusion.

TABLE 3

| Length from Overtip | CIGARETTES C Score | D Mean values | Significance |
|---|---|---|---|
| 43 mm | 1.26 | 1.28 | NS |
| 23 mm | 1.94 | 2.23 | * |
| 3 mm | 2.94 | 3.71 | *** |

*90% significance level
***99% significance level

The test indicates that there is a significant perceived difference in temperature of the smoke at a 99% confidence level at a location 3 mm from the overtip, i.e. the Cigarettes C according to the invention have a cooler smoke in the last few puffs.

We claim:

1. A smoking article comprising a material rod and filter means disposed at one end of said rod, said rod comprising smoking material, and a paper wrapper circumscribing said smoking material, the density of said smoking material in said rod being in a range of about 100 mg $cm^{-3}$ to about 260 mg $cm^{-3}$, said material rod comprising at least 20 percent by weight of expanded tobacco and said filter means comprising a body of low filtration efficiency material, the filtration efficiency of said filter body being less than 45 percent for particulate matter, and ventilation means operable to provide a ventilation level of at least 30%, and the pressure drop of said body of said filter being selected in order to provide a smoking article having acceptable smoke mechanics.

2. A smoking article according to claim 1, wherein said body of low filtration material comprises cellulose acetate and/or polyolefin.

3. A smoking article according to claim 2, wherein said polyolefin is polyethylene.

4. A smoking article according to claim 1, wherein the ventilation means is located downstream of the body of low filtration efficiency material.

5. A smoking article according to claim 1, wherein the level of ventilation is 40%.

6. A smoking article according to claim 1, wherein the level of ventilation is 50%.

7. A smoking article according to claim 1, wherein the paper wrapper of said smoking material rod comprises a sidestream reducing agent.

8. A smoking article according to claim 1, wherein the paper wrapper comprises a total filler content of about 20% or less, a proportion at least of the filter being a filler effective for visible sidestream reduction, and the weight of the paper being about 30 grams per square meter or more.

9. A smoking article according to claim 1, wherein the inherent permeability of the paper wrapper is not more than about 20 Coresta units.

10. A smoking article according to claim 1, wherein said smoking material comprises at least 30% or more of expanded tobacco.

* * * * *